US005906705A

United States Patent [19]

Chung et al.

[11] Patent Number: 5,906,705

[45] **Date of Patent: *May 25, 1999**

[54] RETRACTABLE BLADE HAND HELD TAPE APPLICATORS

[76] Inventors: Wu-Hsiung Chung, 3848 E. Mandeville Pl., Orange, Calif. 92667; Jow-Lin Tang, 524 Green Acre Dr., Fullerton, Calif. 92635; Kirk Ko-Chien Wei, 23907 Falcons View, Diamond Bar, Calif. 91765

[ * ] Notice: This patent is subject to a terminal disclaimer.

[21] Appl. No.: 08/818,603

[22] Filed: Mar. 14, 1997

Related U.S. Application Data

[63] Continuation of application No. 08/330,005, Oct. 26, 1994, Pat. No. 5,641,377.

[51] Int. Cl.[6] ..... B32B 31/00

[52] U.S. Cl. ..... 156/579; 156/523; 156/577

[58] Field of Search ..... 156/523, 526, 156/574, 577, 579

[56] References Cited

U.S. PATENT DOCUMENTS

| | | | |
|---|---|---|---|
| 2,493,737 | 1/1950 | Burns . | |
| 2,666,544 | 7/1954 | Ho Chow . | |
| 3,186,892 | 6/1965 | Walthers . | |
| 4,352,710 | 10/1982 | Makley . | |
| 4,486,263 | 12/1984 | Monzo Gomez . | |
| 4,818,329 | 4/1989 | Tutas et al. . | |
| 4,826,562 | 5/1989 | Ehlis | 156/577 X |
| 4,857,134 | 8/1989 | Lin . | |
| 5,110,401 | 5/1992 | Huang | 156/577 X |
| 5,197,386 | 3/1993 | Lin . | |
| 5,236,540 | 8/1993 | Shi . | |
| 5,288,362 | 2/1994 | Shuh Chin . | |
| 5,393,367 | 2/1995 | Yu Chen . | |
| 5,490,898 | 2/1996 | Koyama | 156/577 X |
| 5,641,377 | 6/1997 | Chung et al. . | |

*Primary Examiner*—James Engel
*Attorney, Agent, or Firm*—Curtis L. Harrington

[57] ABSTRACT

The tape dispensers of the present invention employ a variety of features which may be used singly or in conjunction with the other features. The features include a mechanism which extends the blade when pivotal pressure is applied to a shield or lever, thus enabling the use of a sharper blade, and in a more extended configuration during the cutting of tape. Another feature is the fitting of a smaller sized spool to engage smaller diameter cores on which tape is provided with an adapter which fits onto the smaller sized spool and having a helixed slot is provided to insure that as the tape is being dispensed, the adapter is continuously urged into full engagement with the smaller sized spool. Other features are embodied into a base-type tape dispenser which includes a manual mechanism for obtaining lengths of tape, combined with the use of the portable portion which may be removed and used as a hand-held dispenser. Another feature is in the use of a single piece dispenser which dispenses tape in a first direction toward an abbreviated blade, or a second direction which enables the dispenser to be grasped from the bottom and used to apply tape to a surface directly, and which may be magnetically mounted to a heavy metal base.

6 Claims, 7 Drawing Sheets

35
27
2–3
31
33
29
49
47
CAUTION
45
43
53
2–3
59
25
55
57
41
39
59
59
37
21
23

RETRACTABLE BLADE HAND HELD TAPE APPLICATORS

This is a continuation, of U.S. patent application Ser. No. 08/330/005 filed Oct. 26, 1994 now U.S. Pat. No. 5,641,377.

FIELD OF THE INVENTION

The present invention relates to the field of devices used to assist in the application of adhesive tape. More specifically, the present invention relates to structures which are safer, which enables a more effective cutting of dispensed tape, and some of which enable dual service as both a stand alone and hand held unit for application of tape.

BACKGROUND OF THE INVENTION

Adhesive tape dispensers are known which are both base-type models and which are hand held models. With the base type model, the cutting blade can be abbreviated in length since the fingers can be used to manipulate the tape adjacent the cutting edge. The manipulation can twist the tape across the cutting blade to always achieve a good cut. Usually a smooth flat surface is provided for the hands to manipulate the tape onto to hold it from the roll dispenser side of the blade to hold that side of the tape while the hand holds the other side for tearing.

This arrangement is fine for short lengths of tape which may be handled and applied manually. For application of extended lengths of tape in packaging operations, longer lengths of tape have a tendency to get caught on itself, to bunch up and to defeat the application to which the user wished to employ the tape in the first place.

One of the devices which has been employed over the years is the wholly manual tape applicator. This applicator usually consists of a handle supporting a spool and device to guide and dispense the tape. Usually with wider tape dispensers, such as tape from two to three inches wide, the cutting blade will consist of a sharply serrated or deeply serrated edge. By deeply serrated is meant that the triangular serrations fall into a range in which they may be higher than they are wide, to as much as three times as tall as they are wide. This serrated edge will have teeth which are somewhat shallow and which project from an edge of the tape dispenser. In some cases a stiff plastic shield is supplied at an angle which serves several purposes.

In some cases the shield helps the user to know the angular limitations of the tape dispenser necessary to permit the continued dispensing of tape. So long as the shield is not touching the package, the tape will continue to be freely dispensed. In some cases the plastic shield is pressed against the last bit of dispensed tape to help the user form an angular orientation of the dispenser which will maximize the probability that the tape will be able to be cut. This is so since it may take several attempts to try to force the abbreviated serrated blade against the tape to cut the tape.

Thus the blade of the conventional tape dispenser is made with several objectives in mind. First, it must not protrude too far. A blade which protrudes too far can cause negative consequences including (1) the tape may be cut before the user is finished dispensing the tape to the desired length, (2) the blade may seriously cut and injure the user or others, or (3) the blade may be damaged through simple handling of the manual dispenser, as by putting it down onto a hard surface. If the blade on most dispensers were to be mounted any less predominantly, it would be virtually impossible to cut the tape without having to manipulate the tape about the blade with the free hand. If resort to both hands must be had, a user would just as soon use the tape from a stand alone dispenser.

In general, tape dispensers of the presently used type work poorly in cutting the tape. This may not seem an important factor, but where one's job is packaging and it is performed continuously, a slight limitation in efficiency can mount up to significant dollar expenditure.

Another problem in the tape dispenser field deals with the core size of the rolls. Although most two inch tapes are available on a three inch diameter spool, some tapes are available on a one and a half inch spool. Conventional hand held tape dispensers do not have the capacity to accept both types of tape supply spools. A non-specific core adapter would be insufficient to insure that the tape supply roll would be guided into a good fit.

For still other tape dispensers, the user is forced to choose between a stand alone tape dispenser, or a manually utilized tape dispenser, or have to buy both. When the user is down to a single roll of tape, this roll of tape would need to be changed between the stand alone and the manually activated tape dispenser. Each time the tape is changed between these two, further waste can be generated in having to pick the tape off of the spool to re-start its use in the dispenser which fits the use for which the tape is needed.

Further, a table mounted tape dispenser has a tendency to be located in a central place, not towards being misplaced. Hand-held dispensers are more prone to being misplaced, especially where their appearance does not suggest the return to a location. What is therefore needed are tape dispenser configurations which satisfy the above limitations on tape dispensers in conventional use.

SUMMARY OF THE INVENTION

The tape dispensers of the present invention employ a variety of features which may be used singly or in conjunction with the other features to yield a superior and advantageous product.

In a first embodiment, a hand held dispenser employs a mechanism which extends the blade when pivotal pressure is applied to a shield or lever. This enables the use of a sharper blade, and in a more extended configuration during the cutting of tape, while not having to be as concerned with the injury the blade might cause in its resting position.

The dispenser of the first embodiment may optionally be fitted with a smaller sized spool to engage smaller diameter cores on which tape is provided, as well as having an adapter which fits onto the smaller sized spool. A helixed slot is provided to insure that as the tape is being dispensed, the adapter is continuously urged into full engagement with the smaller sized spool. This helps in holding the tape onto the dispenser.

In another embodiment, a base-type tape dispenser includes a mechanism which allows the tape to be manually engaged, pulled from the roll and torn down across an abbreviated length blade. The portion of the dispenser which holds the tape roll may be grasped and removed from the dispenser and used as a hand-held dispenser. This embodiment, as will be shown, is also fittable with the extending/retracting blade of the first embodiment. After use as a manually applied dispenser, the manual portion can be readily re-attached to the base and tape used from the dispenser in a conventional base-mounted fashion.

In another embodiment, a dispenser is configured to be used as a single piece base style dispenser which dispenses tape in a first direction toward an abbreviated blade, and to have the tape re-directed to a second direction which enables the dispenser to be grasped from the bottom and used to apply tape to a surface directly. As a variant on this embodiment, the dispenser may be made light weight and with magnets to secure it to a heavy metal base, or the dispenser may be made as one piece and having a curved indentation along its lower edge to facilitate manual grasping.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
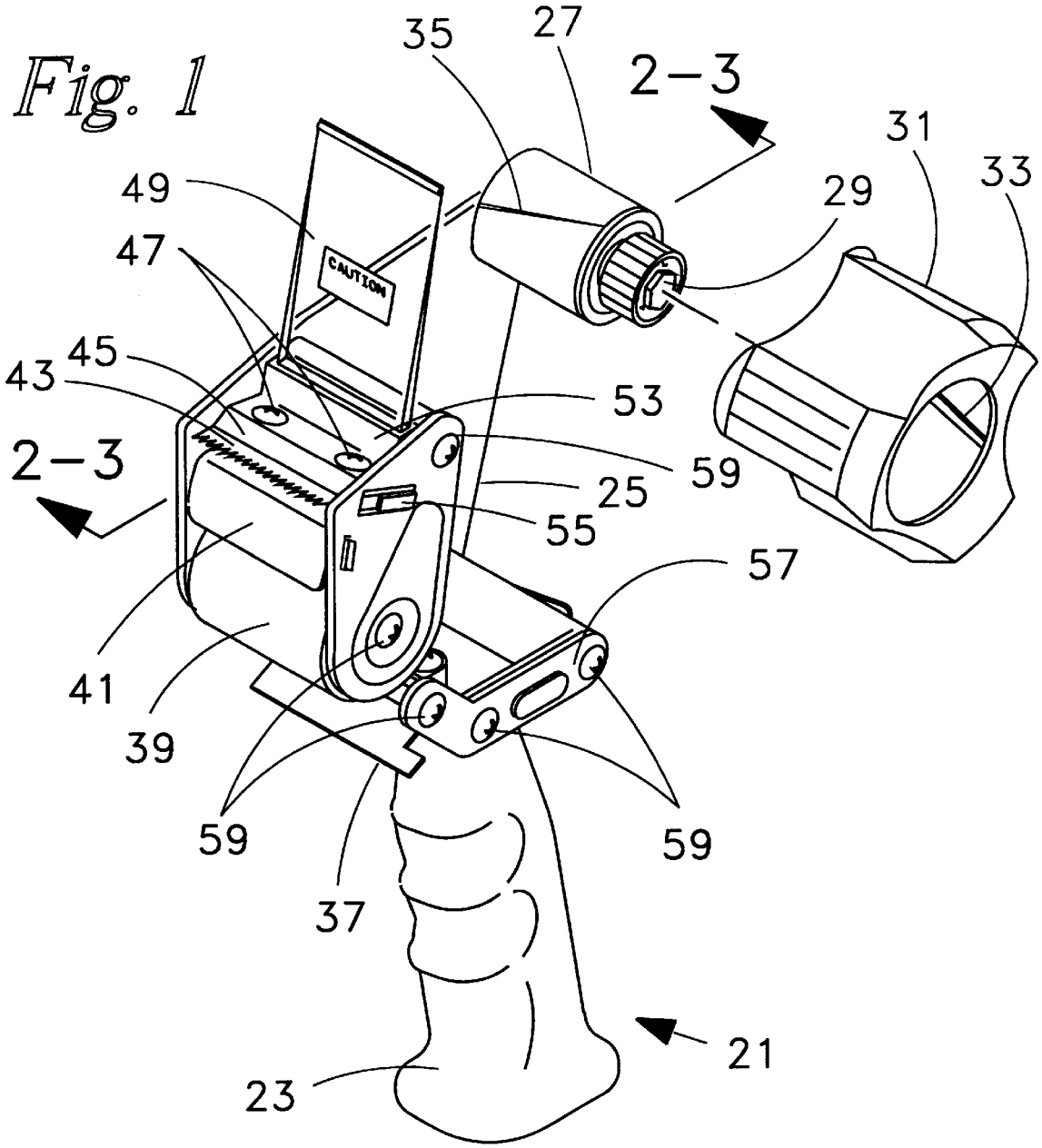
FIG. 1 is a perspective view of a tape dispenser of the present invention and illustrating a specialized adapter to facilitate the use of both small and large diameter rolls of tape.

The description and operation of the invention will be best described with reference to FIG. 1. FIG. 1 is a perspective view of a first embodiment of the tape dispenser of the present invention. A hand-held dispenser 21 has a handle 23 and a frame 25 mounted into and above the handle 23. The frame 25 supports the moveable structures of the dispenser 21. At the rear of the frame 25 is a small diameter spindle 27 and having a tension adjustment knob 29. An adapter 31 is shown in exploded fashion and displaced from the smaller diameter spindle 27.

Adapter 31 has an internal helix shown as structure 33. This structure 33 interacts with a structure 35 on the smaller diameter spindle 27. The structures 33 and 35 may include a slot 33 and a raised rib 35, or a raised rib 33 and a slot 35, or both as raised ribs. However it is clear that such structures, when engaged with each other in a interfitting helix fashion, will cause the adapter 31 to be urged toward the frame 25 with any turning motion placed upon the adapter 31 with respect to the small spindle 27. This is especially true where the small spindle 27 has a tension adjustment 29 which inhibits rotation of small spindle 27, and therefore the larger adapter 31 screws on (slightly) to engage it.

FIG. 1 also illustrates a spring biased gate 37 which may be opened to provide a wider space through which to thread a length of tape (not shown). Gate 37 is shown in the open position, and below a main engagement roller 39 which is used to roll onto the freshly dispensed tape and against the object or surface to which the tape is being applied. Above the roller 39 is a static plate 41 and above plate 41 is a sharply serrated blade 43.

The blade 43 is shown in retracted position, and particularly in relation to the corner of the frame 25 from which it is located behind. Behind the blade 42 is a hold down plate 45 secured by a pair of screws 47. Just behind the plate 45 is a pivoting assembly, including what is preferably a plastic or plexiglass wiper 49 which is pivotally mounted with respect to the frame 25. The wiper 49 may be fitted with a pair of side projections to allow it to pivot.

Note that the structural support for the aforementioned components is had by their dependence upon frame 25, and an upper side plate 55 and a lower side plate 57. The side plates 55 and 57 are connected to the frame 25 by a series of horizontally extending bolts 59.

Figure 2:
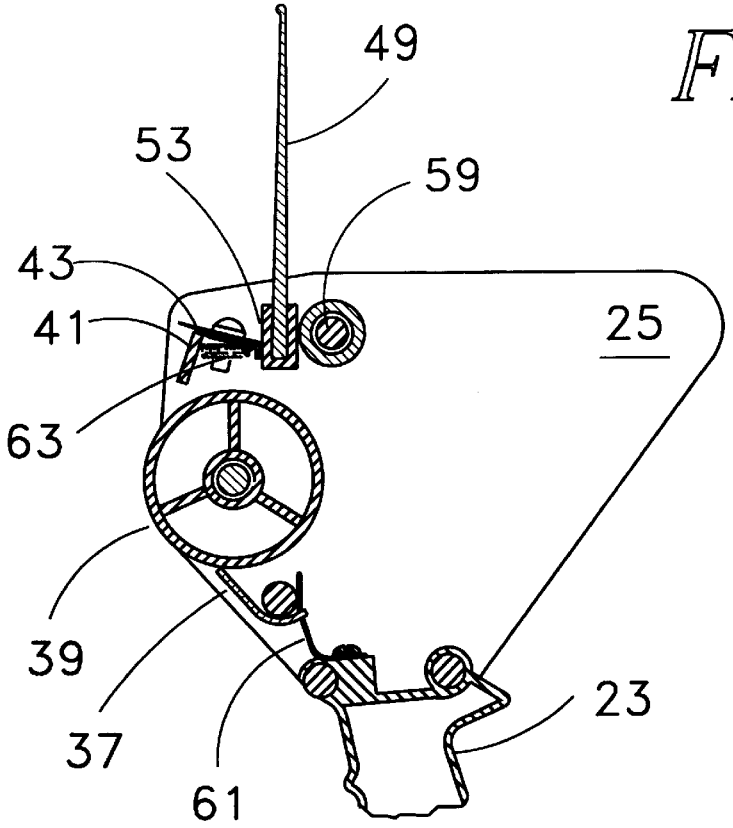
FIG. 2 illustrates further detail of the retracting and extending blade mechanism of the tape dispenser shown in FIG. 1, and shows such mechanism in retracted position.

Referring to FIG. 2, a sectional view taken along line 2-3 of FIG. 1 illustrates the components within the dispenser 21. Newly seen in FIG. 2 is a spring 61 which is used to bias gate 37 into one of its two positions, and in the case of FIG. 2 the gate 37 is shown in the closed position. There is still sufficient clearance between the gate 37 and the roll 39 to freely admit the adhesive tape.

At the upper left corner of FIG. 2 can be seen the cross section of the wipe down blade holder 53 and how it engages the wiper 49. Structure 49 is termsed a wiper due to the "wiping" action which the user performs in pressing down the tape, and to expose the blade 43. If the wiper 49 becomes broken, the portion of wiper 49 engaged by the wipe down blade holder 53 can be removed from the wipe down blade holder 53, and a new wiper 49 replaced therein. The side edge of the wiper holder, its projection into an aperture of frame 25 is not seen in this Figure.

Note the presence of a small spring 63 which engages the blade 41 and urges it into a retracted position. Also note the back edge of the blade 43 and its closeness with the lower portion of the wipe down blade holder 53, at a point below the pivotal engagement of wipe down blade holder 53's engagement with the frame 25 and the side plate 55 (not shown in this view). The location, for mechanical advantage, of the pivot point of the wipe down blade holder 53 with respect to the frame 25 and side plate 55 will depend upon how much it is desired for the blade 43 to emerge, and how much pressure is to be applied to the wiper 49 to cause the blade 43 to emerge. This position is also varied according to the strength of the spring 63.

Figure 3:
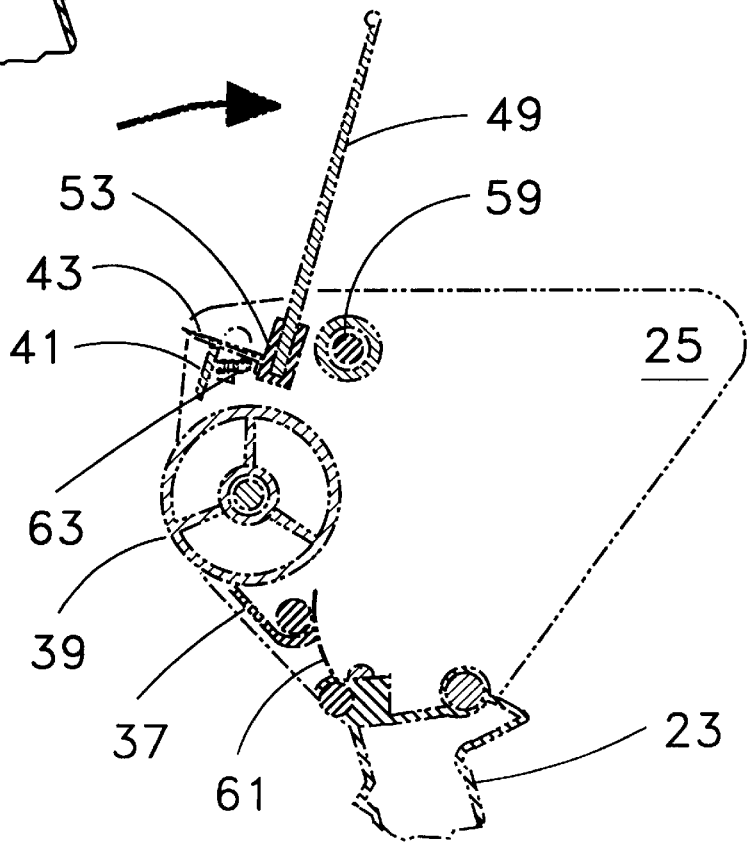
FIG. 3 illustrates further detail of the retracting and extending blade mechanism of the tape dispenser shown in FIGS. 1 and 2, and shows such mechanism in an extended position.

Referring to FIG. 3, this sectional view taken along line 2-3 of FIG. 1 illustrates the components within the dispenser 21 in a position where the wiper 49 is urged into a position against the spring 63 and in which the blade 41 is urged it into an extended position. Here note the forward location of the bottom most portion of the wipe down blade holder 53, and how its bottom portion has pivoted significantly away from the bolt 59. The blade 43 has been shown to emerge significantly beyond the static plate 41, corner of the frame 25 and side plate 55.

Figure 4:
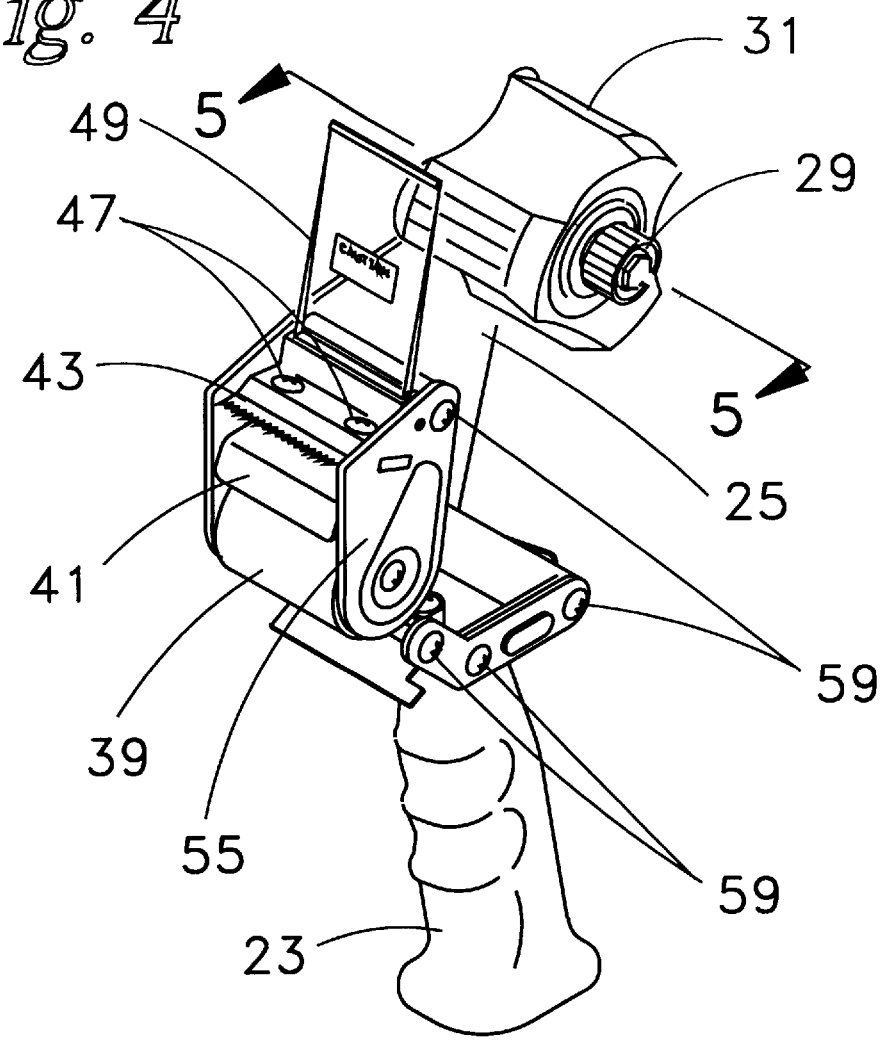
FIG. 4 illustrates the first embodiment in assembled form ready to accept a larger core roll.
Figure 5:
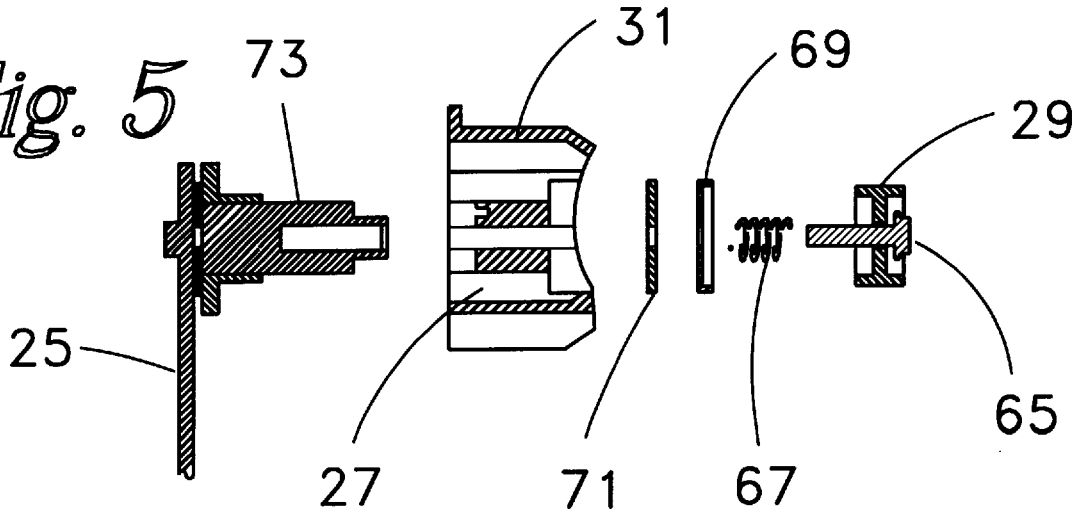
FIG. 5 illustrates an exploded section of the roll tension mechanism and adapter, as shown in FIGS. 1 and 4 as taken through line 5—5 of FIG. 4.

Referring to FIG. 4, a perspective view of the dispenser 21 is shown with the adapter 31 in place. Referring to FIG. 5, further details of the mechanism which works in conjunction with the adapter 31 is shown, and which is a sectional view taken along line 5—5 of FIG. 4. Tension adjustment 29 surrounds and operates a tension bolt 65 against a spring 67 and against a teflon or plastic wear ring 69 and a friction disc 71. The small spindle 27 can be seen as engaging an axle member 73, which also rotates on a shaft that the tension bolt 65 screws into.

Figure 6:
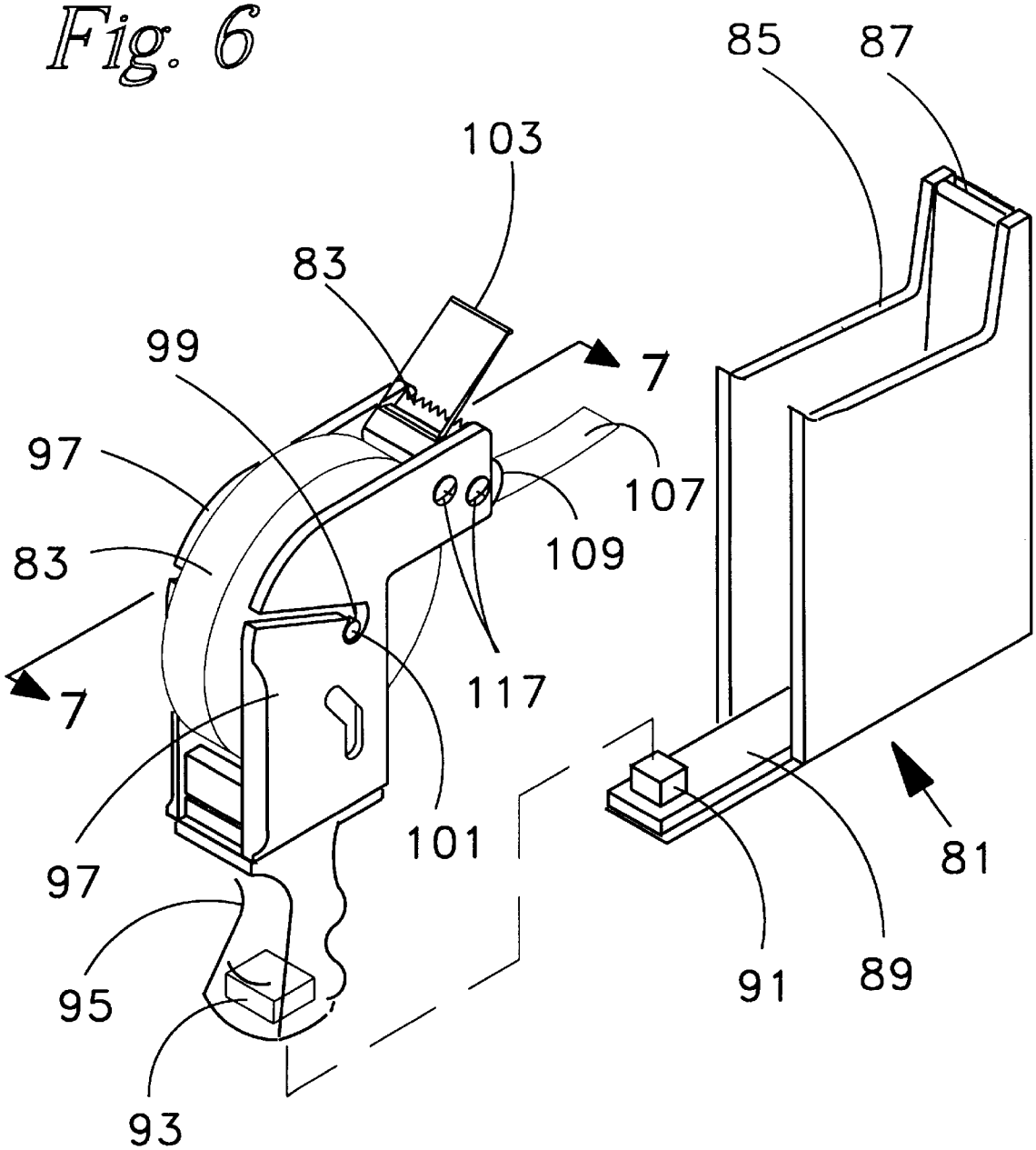
FIG. 6 illustrates another embodiment of the tape dispenser of the present invention, having a base which serves to dispense tape in a base manner, but which also has a handle engaging the dispenser portion and having a mechanism which facilitates the dispensing of tape and which may be separated from the base portion and shown with the manual dispenser portion shown in detached position.

Referring to FIG. 6, another embodiment of the tape dispenser of the present invention is shown. This type of dispenser 81 is shown with a relatively narrower tape roll 83. The dispenser 81 is equipped with a base 85 having an elevated section including an abbreviated length cutting blade 87 which works well with physical manipulation of tape as would be present with a conventional tape dispenser, including but not limited to table top dispensers. The base 85 has an elongate lower plate 89 supporting an upwardly extending projection 91. Projection 91 is shaped and sized to fit within a matching space 93 (shown in phantom) formed into the bottom of a handle 95.

The handle 95 indicates its resting place on the lower plate 89 and over the projection 91. The handle 95 supports a housing formed by a pair of plates 97 which support the roll 83. The plates 97 each have a slot 99 which accepts one side of an axle 101 which supports roll 83. A pair of restraining structures (not shown in FIG. 6) hold the ends of the axle 101 in the lower-most slot of each of the plates 97. This is necessary where the portable portion of the dispenser 81 will be inverted in the normal course of use. By deliberately manipulating the roll 83, and its axles 101 against the internal restraining structures, the roll 83 may be removed, but it will not be apt to fall through the slots 99 by its own weight.

The dispenser 81 employs the extendable/retractable blade which was present with regard to the embodiment of FIG. 1, and therefore has a shield 103 and an extendible/retractable blade 83. A length of tape 107 is shown extending toward the blade 87. With this mode of operation, the sticky side of the length of tape 107 is downward, and it can be torn using blade 87 with physical manipulation of the tape 107. If the length of tape 107 is bent upwardly, the non-sticky side of the tape will be urged against a roller 109.

In this orientation, the tape can be applied to a package or surface, and torn by urging the shield 103 against the surface to cause the blade 83 to extend into a predominant, cutting stance which easily cut the tape by rotating the portable portion of the dispenser 81.

Figure 7:
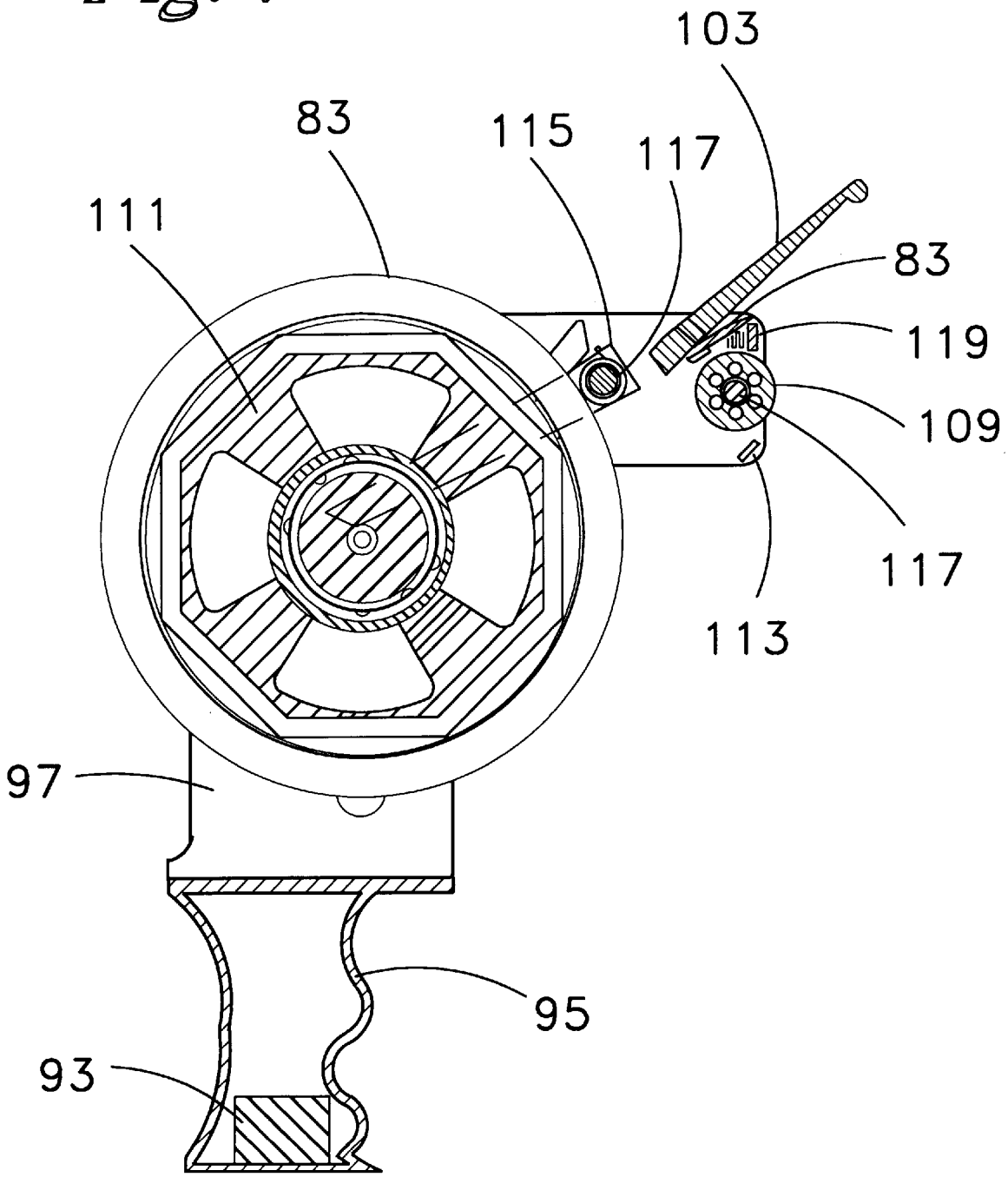
FIG. 7 illustrates a cross section taken along line 7—7 of FIG. 6, and illustrating the internal workings of the dispenser.

Referring to FIG. 7, a sectional view taken along line 7—7 of FIG. 6 illustrates the tape roll 83 being supported by a spool 111 and including the axle 101 which was seen in FIG. 6. FIG. 7 also shows a bottom keeper 113 over which the length of tape 107 will pass on its way to the blade 87. The keeper may extend completely across from one of the plates 97 to the other, or it may consist of a pair of opposing projections 113 to facilitate the threading of the tape through the center space of the projections by some physical manipulation. The projection version is shown in FIG. 7.

The projections 113 also serve the purpose of enabling the sticky side of the tape to stick to the projections as soon as the tape ceases to be dispensably pulled from the roll 83. So long as projections 113 engage the length of tape 107, it will not tend to fall back onto the roll. The area of the projections 113 may vary based upon the type and degree of stickiness of the tape employed. Although most blade 87 assemblies do not easily allow the tape to fall back onto the roll, the physical manipulation of the portable portion of the dispenser 81, supported by the handle 95, may cause it to be moved about smartly.

When used in the manual, portable mode, and once a package or surface is taped, and once the dispenser wiper/shield 103 bears against the surface taped to enable the blade 83 to extend and cut the tape, a length of tape will remain beyond the projections 113. This length of tape 107 will be available to be pressed onto the next surface to be taped and immediately engage the roller 109. In this fashion, the taping operation can proceed continuously, there always being a length of tape 107 available to begin the next taping.

Other structures seen in FIG. 7 include one of the restraining structures 115, shown partially in phantom and pivoting about one of the bolts 117 which hold the plates 97 in place. The restraining structures 115, which may be a unitary structure having a pair of extensions, bear downward, but are displaced upwardly by the axles 101 when the spool 111 is urged into position. Once the axles 101 reach the end of the slots 99, the restraining structures 115 urge axles down into the lower end of the slot 99, of which FIG. 6 shows the axle 101 in just such a position.

A plate 119 is shown below the blade 83, and the roller 109 is shown as bearing against another one of the bolts 117 which hold the plates 97 in place.

Figure 8:
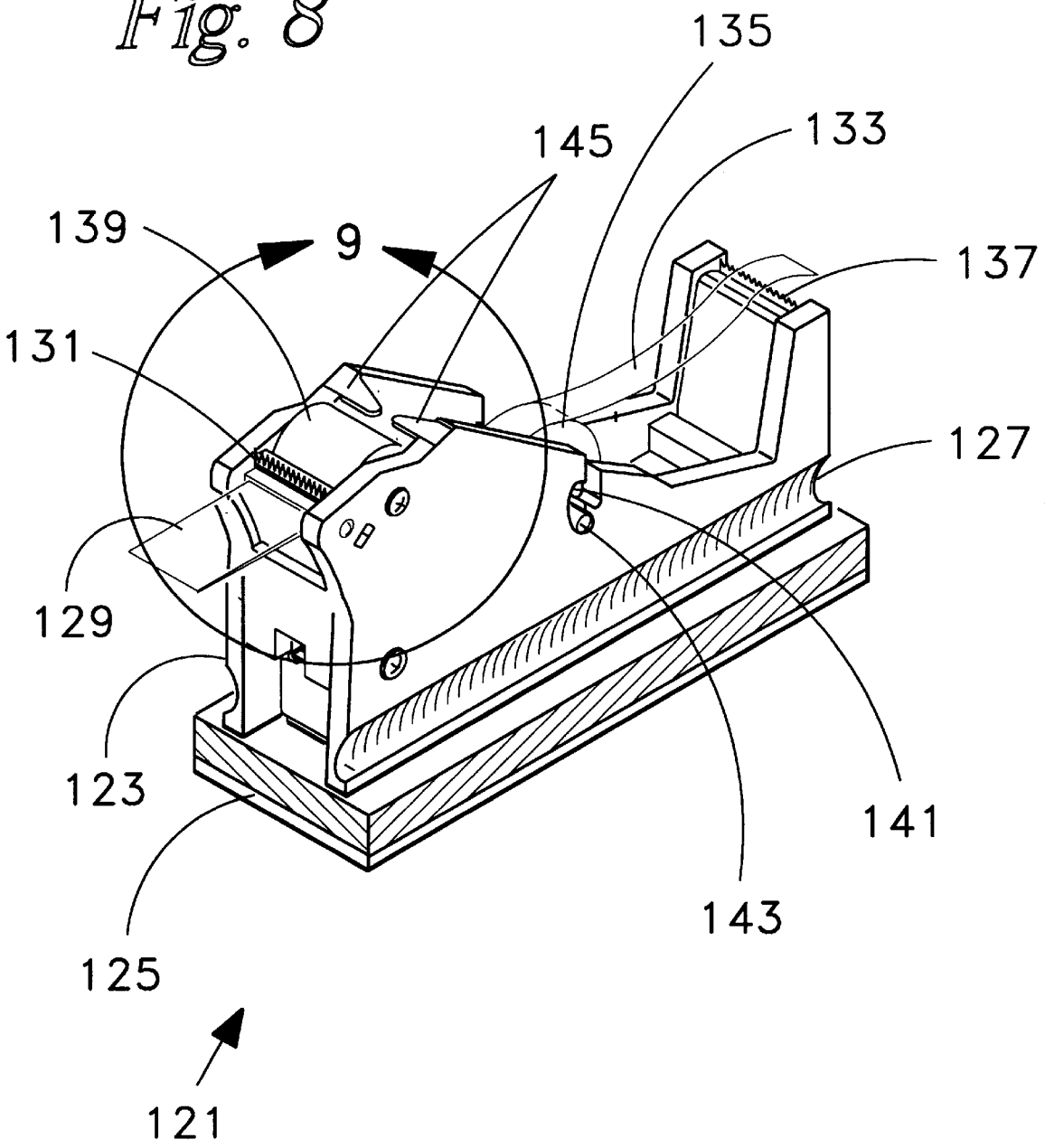
FIG. 8 is a further embodiment of the tape dispenser of the present invention and illustrating a base mounted dispenser atop an optionally provided heavy metal base.

Referring to FIG. 8, another embodiment of the present invention is shown. This dispenser 121 takes on a shape similar in only a few ways to the shape of a conventional desk dispenser. In the embodiment of FIG. 8, the upper portable dispenser portion 123 sits atop, and is magnetically attracted to a heavy metal base plate 125. However, the upper dispenser portion 123 is formed with a groove 127 to facilitate grasping of the upper dispenser portion 123.

The extendable/retractable blade which was present with regard to the embodiment of FIG. 1 and FIG. 6, is also present in the embodiment of FIG. 8, and therefore has a shield 129 and an extendible/retractable blade 131. A length of tape 133 is shown extending from a roll 135 and toward a fixed, abbreviated length, blade 137. With this mode of operation, the sticky side of the length of tape 133 is downward, and it can be torn using blade 137 with physical manipulation of the tape 133. If the length of tape 133 is bent upwardly, and in a direction opposite the blade 137, the non-sticky side of the tape will be urged against a roller 139.

In this orientation, the tape can be applied to a package or surface, and torn by urging the shield 129 against the surface to which tape is applied to cause the blade 131 to extend into a predominant, cutting stance and which will easily cut the tape by rotating the portable portion of the dispenser 121.

Note the presence of an "s" shaped slot 141 which begins vertically, reverses direction and toward the front of the upper portion 123 and then vertically downward.

The dispenser 121 also employs restraining structures similar to restraining structures 115 of FIG. 7 to urge axle 143 of a spool (not shown) forward into the lower vertical portion of the slot 141 to trap the roll 135.

Also shown in FIG. 8 is a keeper 145 over which the length of tape 107 will pass on its way across the roller 139 when the upper portion 123 is used as a portable tape dispensing unit. Although the keeper may extend completely across from one side of the upper portion 123 to the other, here it is shown as consisting of a pair of opposing projections 145 to facilitate the threading of the tape through the center space of the projections by some physical manipulation.

The projections 145 again serve the purpose of enabling the sticky side of the tape to stick to the projections as soon as the tape ceases to be dispensably pulled from the roll 135 when the dispenser upper portion 123 is used as a portable dispenser.

So long as projections 145 engage the length of tape 133, it will not tend to. fall back onto the roll. The area of the projections 145 may vary based upon the type and degree of stickiness of the tape employed. Again, when used in manual, portable mode, and once a package or surface is taped, and once the dispenser 121 bears against the surface taped to enable the blade 131 to extend and cut the tape, a length of tape will remain beyond the projections 113. This length of tape 107 will be available to be pressed onto the next surface to be taped and immediately engage the roller 109. In this fashion, the taping operation can proceed continuously, there always being a length of tape 107 available to begin the next taping.

The use of hold down magnets (not shown in FIG. 8) to a heavy base 125 enables the upper portion 123 to be made of very light weight materials to reduce fatigue when being manipulated as a portable dispenser. When magnetically attached to the heavy base 125, the dispenser 121 will behave like a weighted dispenser which is supposed to not be easily moved or knocked over. In this manner, both a light-weight portable dispenser and a weighted-down base dispenser is had in a single embodiment. Of course, upper portion 123 may be provided as a single dispenser, and may be weighted to a weight in between the weight of the dispenser 121 including the plate 125, a weight equal to the lightest weight possible for the upper portion 123, or anywhere in between.

Figure 9:
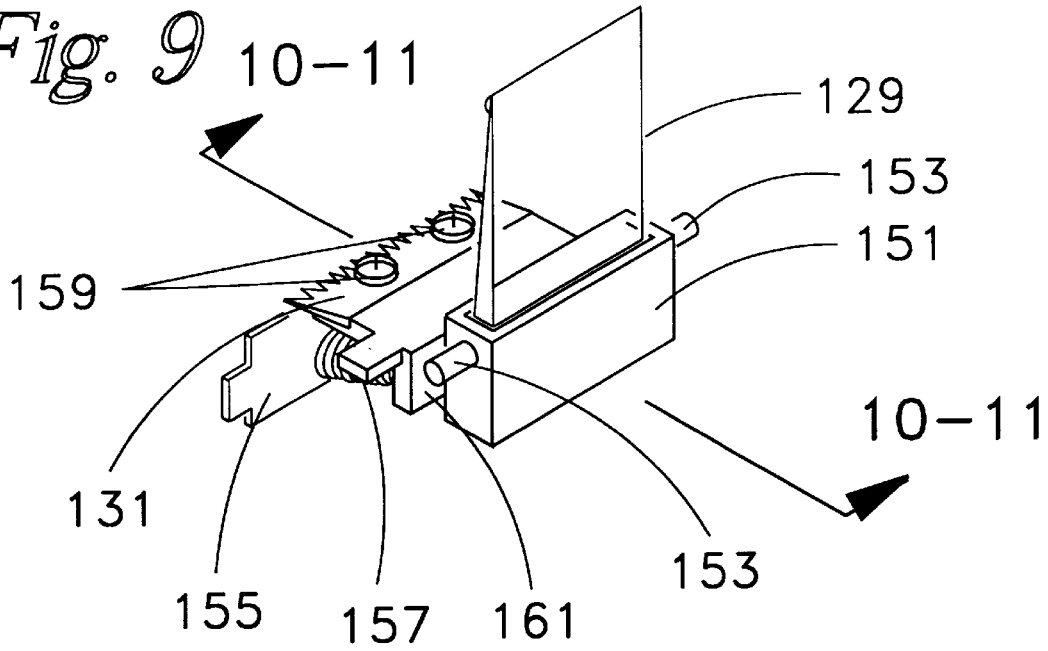
FIG. 9 is a closeup view of the mechanism for blade extension/retraction as indicated in the circled area shown in FIG. 8.

Referring to FIG. 9, a closeup of the mechanism of dispenser 121 is seen. Now is seen the structure which underlies the wiper 129. The wiper 129 fits into a wiper holder 151. The wiper holder 151 may be shaped like a rectangular cup which supports and holds the wiper 129. Wiper holder 151 may be made of sheet metal or plastic. The wiper holder 151 has a pair of side projections 153 which pivotally engage the housing of the upper portion 123 of the dispenser 121 and enable the wiper holder 151 to pivot. The wipe down blade holder 53 and 131 is constructed in the same manner as wiper holder 151.

A plate 155 is seen, and in this case supports a spring 157 which acts to urge blade 131 in place in a retracted position. Blade 131 is shown as an independent structure in FIG. 9, although it is not required to be such. A pair of screws 159 hold the blade 131 onto a blade support 161. The blade support 161 may have a tab on each end that slides in a slot in ieach side of the frame.

Figure 10:
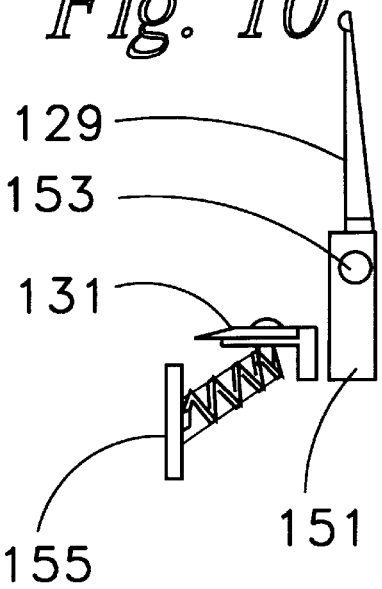
FIG. 10 is a sectional view as taken through line 10-11 of FIG. 9 and illustrating the extension/retraction mechanism in retracted position.
Figure 11:
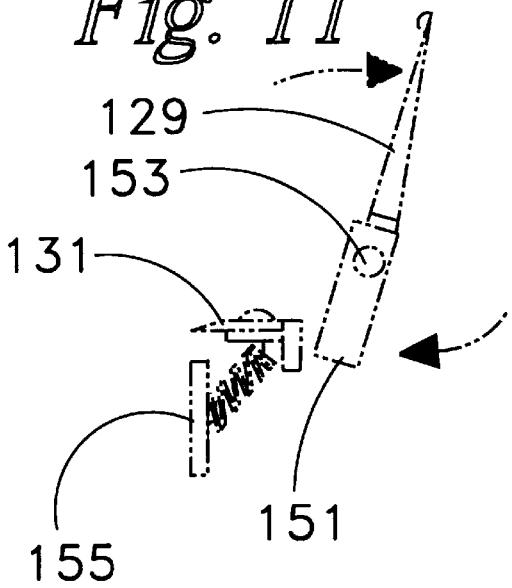
FIG. 11 is a sectional view as taken through line 10-11 of FIG. 9 and illustrating the extension/retraction mechanism in extended position.

Referring to FIG. 10, a side view of the mechanism of FIG. 9 illustrates the action of the blade 131 based upon movements of the wiper 129 and the holder 151. Based upon the schematic nature of FIG. 10, the blade 131 and its blade support 161 are combined into a single unit which will be referred to as blade 131. FIG. 10 illustrates the blade 131 in retracted position. FIG. 11 illustrates the blade 131 in extended position, urged outwardly by the pivoting about side projections 153, with the bottom of holder 151 pushing the blade 131 forward.

While the present invention has been described in terms of a portable and combination fixed and portable tape dispensing system, one skilled in the art will realize that the structure and techniques of the present invention can be applied to many appliances. The present invention may be applied in any situation where system components are sought to be rapidly and easily retracted and extended to increase the utility in a useful appliance.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A tape dispenser comprising:

a support portion;

a tape roll support for rotationally supporting a roll of tape, and further comprising:

a spindle rotatably mounted with respect to said support portion and having an external surface defining at least one of a groove and a slot structure, said external surface of said spindle for overfitting of a first core supporting a roll of tape, said first core having a first core size; and an adapter having an internal surface defining the other of said at least one of a groove and a slot structure, and inter-fittable over said spindle, and having an external surface for overfitting of a second core supporting a roll of tape, said second core having a second core size relatively larger than said first core size;

wherein said groove and said slot structures of said spindle and said adapter are slanted with respect to the axis of said spindle to urge said adapter onto said spindle in response to a turning force applied to said adapter.

2. The tape dispenser as recited in claim 1 and further comprising a tension adjustment which adjusts the force required to rotate at least one of said spindle and said adapter.

3. The tape dispenser as recited in claim 1 and further comprising a roller, rotatably supported by said support portion and positioned to bear against a length of tape extending from a core mounted on one of said spindle and said adapter.

4. The tape dispenser as recited in claim 1 wherein said first core size is nominally about 1.5 inches in diameter and wherein said second core size is nominally about 3.0 inches in diameter.

5. The tape dispenser as recited in claim 1 and further comprising a handle attached to said support.

6. The tape dispenser as recited in claim 1 and further comprising a cutting blade supported by said support.

* * * * *